US005667175A

United States Patent [19]

Brady

[11] Patent Number: 5,667,175

[45] Date of Patent: Sep. 16, 1997

[54] VERSATILE, WIND-RESISTANT SIGN STAND

[75] Inventor: J. Lee Brady, Huntsville, Ala.

[73] Assignee: ADRA Corporation, Huntsville, Ala.

[21] Appl. No.: 488,170

[22] Filed: Jun. 12, 1995

[51] Int. Cl.[6] ..... G09F 15/00

[52] U.S. Cl. ..... 248/166; 40/606; 40/611; 248/172; 248/176.3

[58] Field of Search ..... 248/125.1, 125.2, 248/165, 166, 172, 176.1, 176.3; 40/606, 610, 611, 612

[56] References Cited

U.S. PATENT DOCUMENTS

| | | | |
|---|---|---|---|
| 3,847,335 | 11/1974 | Ross | 248/166 |
| 4,203,242 | 5/1980 | Griffin | 40/610 |
| 4,233,769 | 11/1980 | Archer | 40/610 X |
| 4,569,499 | 2/1986 | Seely . | |
| 4,676,015 | 6/1987 | Stoudt . | |
| 4,905,391 | 3/1990 | Dillon | 40/606 X |
| 5,094,023 | 3/1992 | McVey | 40/606 |
| 5,208,585 | 5/1993 | Spraque . | |
| 5,318,258 | 6/1994 | Lang . | |

*Primary Examiner*—Derek J. Berger
*Attorney, Agent, or Firm*—C.A. Phillips; Joseph H. Beumer

[57] ABSTRACT

A portable sign stand has a tripod frame in which one leg carries a self-adjusting bracket that urges a rigid sign upward against a pair of buttons near the top of the frame. The two other legs of the tripod are linked to one another and to an upright extension member that is connected to the leg carrying the bracket. Another pair of buttons connected to a plate of the bracket support a bottom corner or edge of the sign for being moved upward and held in position. The bracket is forced upward into position by an elastic cord. Legs of the tripod are made of square aluminum tubing. The bracket also carries an upright receptacle into which a mast of a roll-up may be placed and supported without use of buttons. Provisions are made for carrying various types of signs in different positions, depending on wind conditions and other factors.

18 Claims, 4 Drawing Sheets

VERSATILE, WIND-RESISTANT SIGN STAND

FIELD OF THE INVENTION

This invention relates to portable stands for providing temporary support of traffic signs.

BACKGROUND OF THE INVENTION

Portable road signs find application around roadway repair and construction sites, giving warning of hazardous situations, detours, and the like. Stands for portable signs should be readily collapsible into a small space for storage, handling, and transportation. Maximized wind resistance, consistent with the available weight and design characteristics of the stand, is also a desired feature along with high-strength construction and a capability to accommodate signs of various sizes and shapes. In some instances, it may also be desirable to place a given sign at different places on the same stand for a reason such as to obtain the highest possible effective wind resistance under a given set of conditions.

A foremost consideration in design of such stands is the concern for safety which arises out of a need to protect both the work crew around the site and drivers of vehicles which might impact the sign. Efforts toward improving the safety of a sign stand are properly directed toward the following goals: reduction of the impact energy of a stand in motion, reduction of the probability of a direct impact of a vehicle with the stand, elimination of heavy items such as springs and housings where possible and inclusion of break-away features.

Various types of portable sign stands are disclosed in prior patents. U.S. Pat. No. 5,318,258, issued on Jun. 7, 1994, to Lang, discloses an elongated sign-holding mast supported by a multi-legged base. The legs are pivotally supported for movement and are secured in place by a retainer pin. Sprague in U.S. Pat. No. 5,208,585, issued on May 4, 1993, discloses a portable barrier filled with liquid and having vertically oriented sides and end walls with apertures for attachment of signs. U.S. Pat. No. 4,676,015, issued on Jun. 30, 1987, to Stoudt discloses a stand with a base, a lower staff, and an upper staff for receiving a sign. A spring asserts a force to control the deflection of the upper staff. U.S. Pat. No. 4,569,499, issued on Feb. 11, 1986, to Seely, discloses a frame member foe mounting a sign and a means to allow the sign to pivot or swing under side-wind loads by action of a resilient portion of the stand.

While many prior designs are available, further improvement is needed to obtain maximum versatility of application, stronger wind resistance, and high safety. In terms of capabilities of existing sign stands while operating at varying wind conditions, heavier stands equipped with springs and other apparatus can be effective at wind speeds up to 60 miles per hour, but their costs are relatively high. Simpler and lighter designs are less expensive, but their useful range has been up to about 10 miles per hour. It is desirable to provide a relatively low-cost design that would be effective in an intermediate wind speed range.

SUMMARY OF THE INVENTION

The present invention is directed to a sign stand having a tripod frame that carries two sets of two buttons each for receiving and holding corners or side edges of a rigid sign. A first set is located on a slidable, self-adjusting bracket that rides up and down a main support leg, and a second set has a first button in fixed position on a side of the main support leg near its top and a second button vertically above the first and situated on a center frame member. All of the buttons are located in substantially the same plane so as to receive and secure flat rigid signs.

The self-adjustable bracket is biased upward by a spring means such as an elastic cord which causes the bracket to slide into position. The first pair of buttons on the bracket engage the sign and bring it into contact with the second pair. The sign remains in such contact until released.

The main support leg is connected to the center frame member, which in turn is secured to the two other legs, completing the tripod frame. Rigid signs may be supported by two adjacent corners along one edge thereof and outside the legs of the tripod. The outermost and top corners are left unrestrained in using this embodiment.

Buttons, which may take the form of elevator bolts, may also be located on each of the two other two legs so as to provide for supporting a sign along two lower edges of the sign without being brought into contact with any upper buttons. This configuration may be combined with use of an elastic cord securing the top of the sign to the central support member, urging the sign downward and holding it in position against the buttons. This embodiment is preferred for use when prevailing winds are directed into the sign face.

For use with roll-up signs, the self-adjusting support bracket carries a sign mount in the form of a vertically aligned receptacle into which the mast of the roll-up sign may be plugged. The mast may be secured in the receptacle by means of a detent mechanism which snaps into place.

The sign stands of this invention provide a high degree of versatility in terms of sizes and types of signs for which they are useful. Signs of varying sizes, typically 30-, 36-, and 48-inch, and rigid or rolled-up signs are easily accommodated by movement of the support bracket up and down the main support leg. Different configurations discussed above may be selected for optimum results, depending on wind strength and prevailing wind direction.

The invention also lends itself to incorporation of several safety features. In terms of minimizing damage in the case of the sign being impacted by an automobile or the like, impact energy of the stand in motion is reduced by maximizing surface area and minimizing the weight of the stand. Stands embodying the present invention lend themselves to use of lightweight, high-strength, square aluminum alloy tubing as their main structural feature, and they avoid heavy components such as mechanical springs or other spring-back features previously used on larger stands. The probability of a direct impact with a vehicle can be reduced by use of embodiments wherein the sign is supported outside of the tripod along one leg rather than between two legs facing traffic, as is used for certain other embodiments. Another way of enhancing safety is through the use of break-away features. This category includes the support buttons, which hold the sign securely under normal conditions, but which pull away from and release the sign upon impact by a vehicle or similar event. The stand also may incorporate structural features or connections which provide enough strength for ordinary usage, but break apart when a torsional force is applied as might occur when the sign is impacted.

It is therefore an object of this invention to provide a portable sign stand for receiving and supporting signs of varying sizes and shapes without the use of clamps.

Yet another object is to provide a sign stand that is easily erected and placed in position for use.

Other objects and advantages will be apparent from the following detailed description and claims appended hereto.

DESCRIPTION OF THE PREFERRED EMBODIMENT

Figure 1:
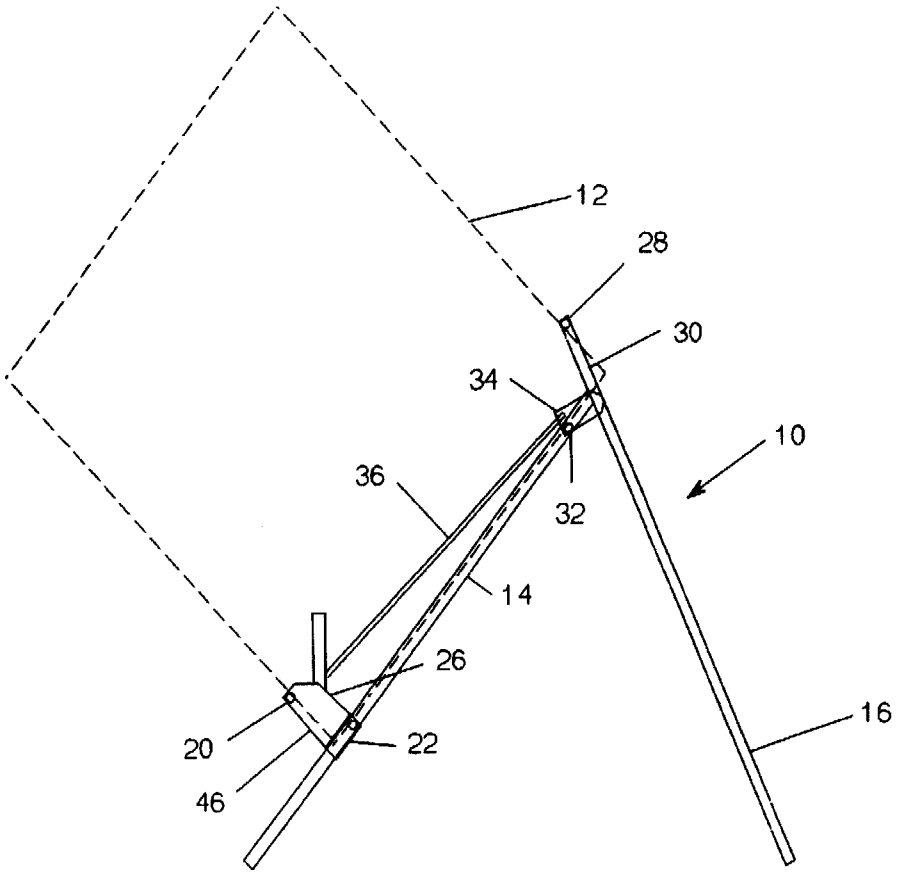
FIG. 1 is an elevational view of an erected sign stand, with a diamond-shaped sign mounted on two sets of buttons thereon as shown in dotted lines.

Referring to FIG. 1 of the drawings, there is shown a tripod stand 10 on which a sign 12 having a diamond shape is mounted. In this view, only one of the two shorter legs 16 (see 16 and 18 in FIG. 2) is shown, with the other one 18 being obscured and not visible. Main support leg 14 carries the sign by engagement of edges at the bottom corner of the sign with buttons 20, 22 mounted on and projecting from a plate 46 which forms one side of a self-aligning support bracket 26. The right corner of the sign is held by button 28 mounted on the stand on the center support member 30 and button 32 mounted on a plate 34 which forms one side of a junction between the main support leg and the center support member. An elastic cord 36, connected to the bracket 26 and to a bushing 38 in aperture 37 of plate 35 (FIG. 5), urges the bracket upward and keeps the sign secured and in contact with the buttons.

Figure 2:
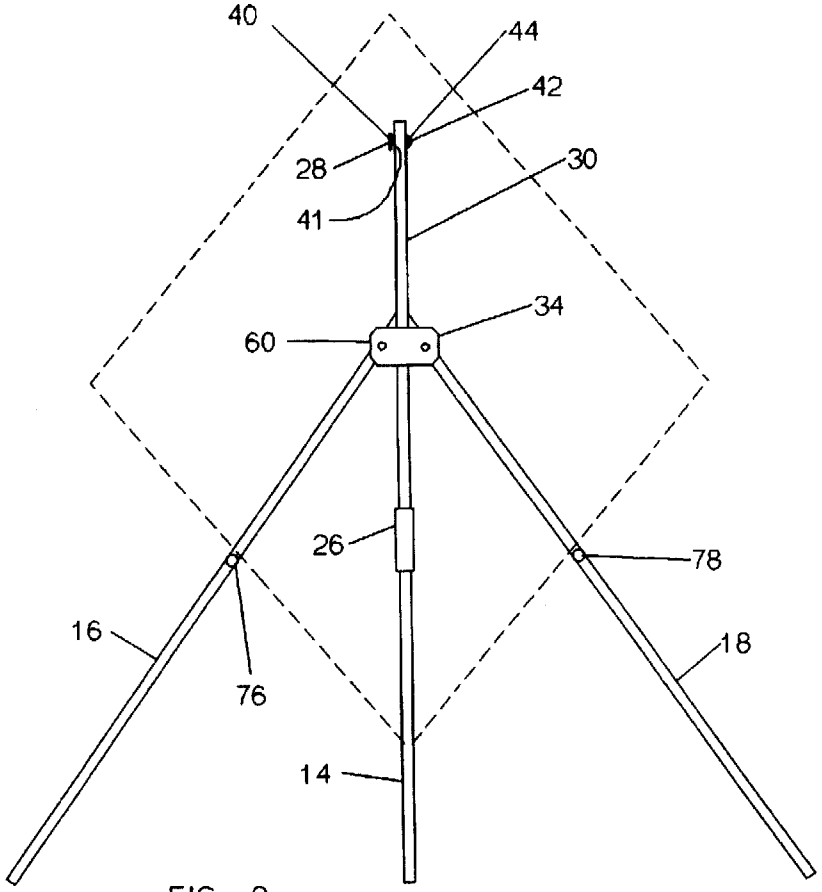
FIG. 2 is an elevational view of a stand with a diamond-shaped sign mounted on two legs of the tripod, with each of the two mounting buttons being located on a different leg.
Figure 4:
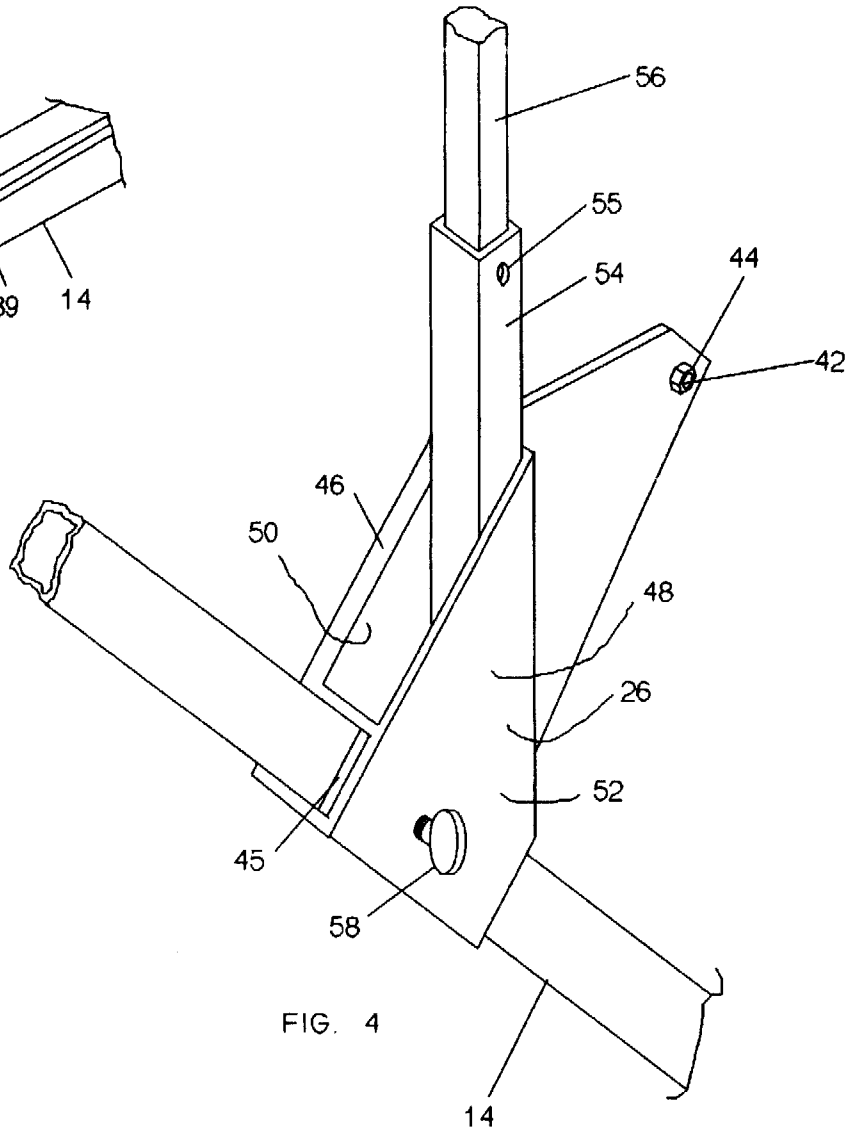
FIG. 4 is a perspective view showing a support bracket and main support leg on which the sign is mounted.
Figure 6:
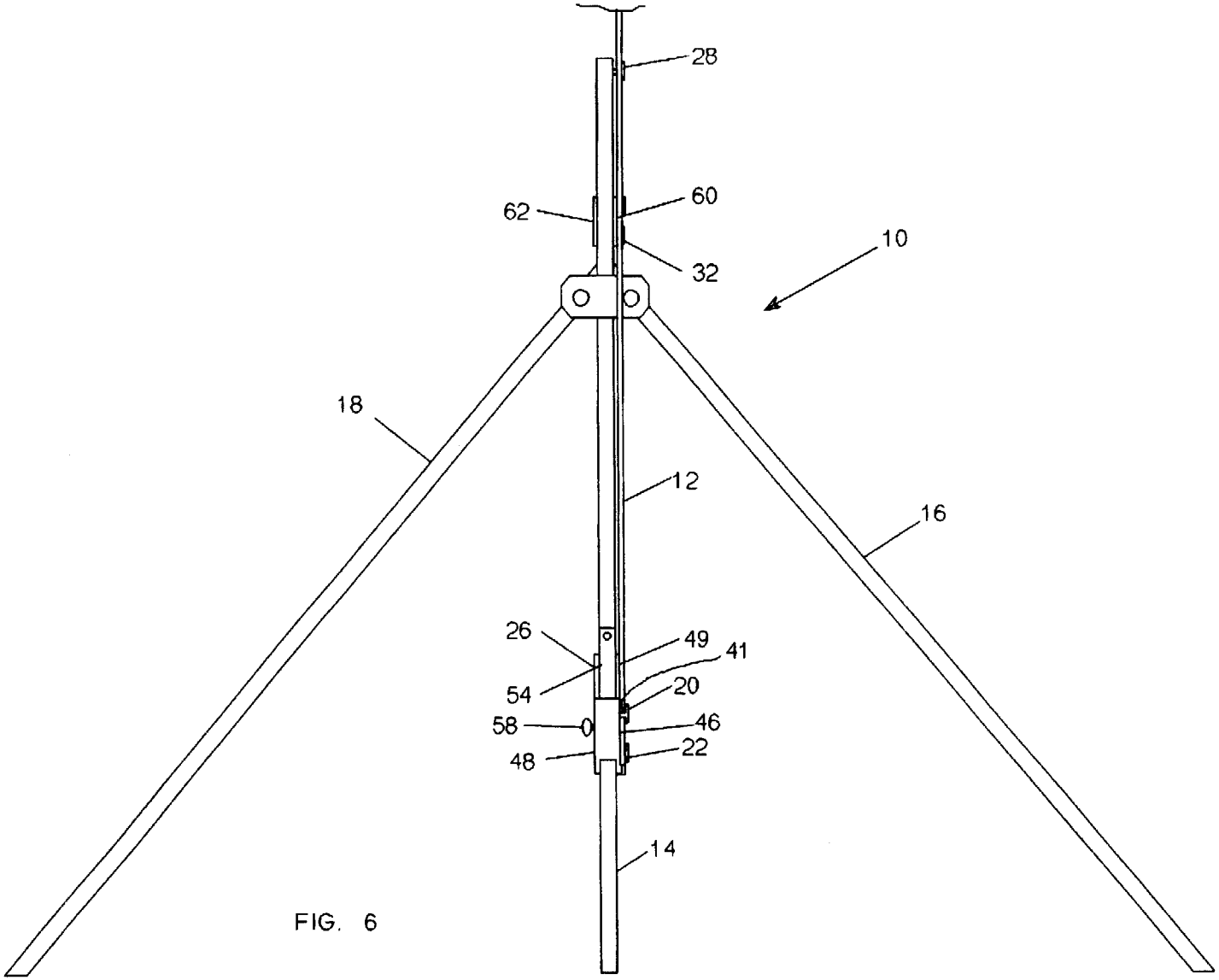
FIG. 6 is an elevational view of the tripod and sign as in FIG. 1, but taken from in front of the main support leg.

Each of the buttons may have the same structure as shown for buttons 20 and 22 in FIGS. 2, 4, and 6. The top of the button is in the form of a metal disc 40 spaced apart above the surface of the leg or plate on which it is mounted. The disc is integrally connected with a bolt member which extends through holes in the leg, an inner spacer portion 41 of the bolt having a square cross section large enough to prevent the button disc from extending flat against the surface. An outer portion 42 of the bolt is threaded and extends through an aperture in the leg or plate and has a nut 44 connected by threads to the bolt. This results in the discs of the buttons being spaced apart one-fourth inch from the surface and being held securely by the nut. The disc of each button prevents the sign mounted thereon from rising up away from the surface of the leg or plate, and the bolt serves as a post, limiting sliding movement of the sign. Commercially available elevator bolts may be used for this purpose.

Self-adjusting bracket 26 rides on main support leg 14 as shown in FIG. 4. The bracket is comprised of a length 45 of square tubing of a size such as to slide over leg 14 and metal plates 46, 48 which are bonded to the tube sections to form sides 50, 52 parallel to the plane in which the buttons are located. Side 50 is generally rectangular with buttons 20, 22 (FIG. 3) located on opposite corners and installed on the plates, the buttons being aligned horizontally to one another when the tripod is erected. An upper corner region above button 20 is truncated to remove unnecessary metal. Side 52 and side 50 are bonded to diagonally extended square metal tubing sections 54 (FIG. 4) which are sized to receive square tubing 56, which forms a mast for rolled-up signs. Tubing segments of the bracket are arranged at an angle of 45° to one another so that when the tripod is erected with the legs at a 45° angle to the ground, the mast receiving tubing will extend upright. Side 52 carries a set screw 58 which may be tightened against leg 14 to hold the sign in place once it is forced upward into the desired position.

Figure 5:
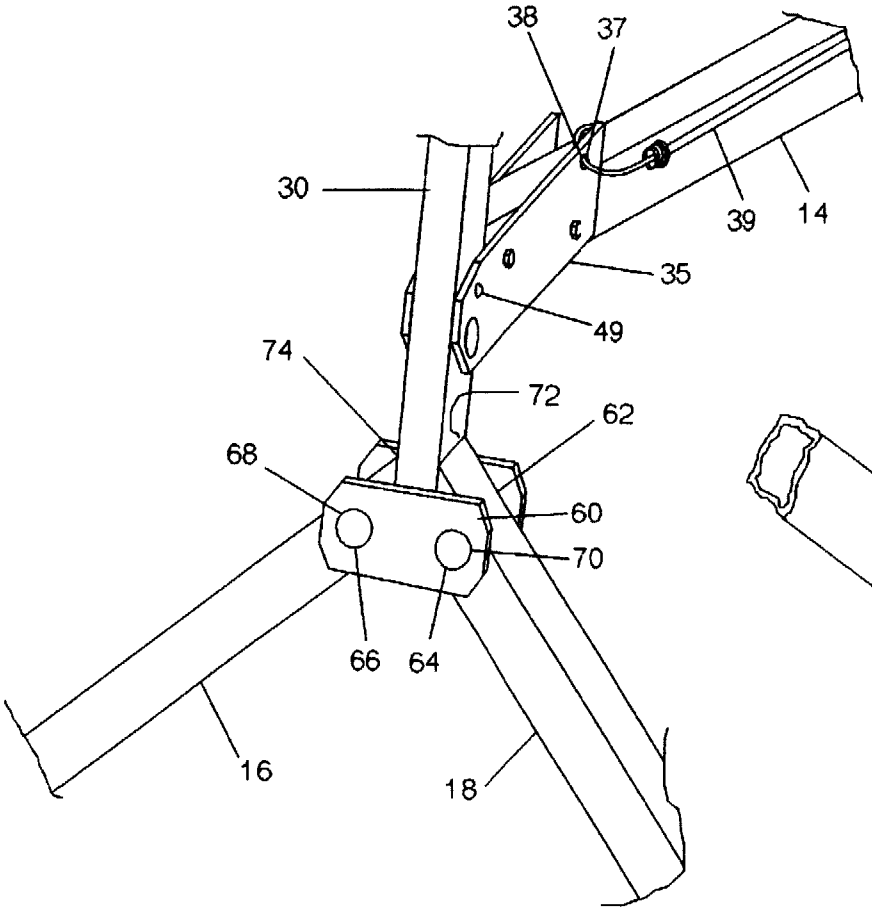
FIG. 5 is a perspective view showing linkage of the three legs of the tripod of the present invention to one another.

FIG. 5 shows linkages and joints which may be used for connecting legs 16 and 18 to one another and to center support member 30 as well as making connection between the center support member and main support leg 14. Clevis-pin type joints may be used.

Plates 60 and 62 are disposed on opposite sides of legs 16, 18 and are pivotally secured to the legs by tube connectors 64, 66 which extend through aligned apertures 68, 70 in the plates and tubing of the legs. Ends of the tube connectors are compressed against the plates, but the upper ends of the legs are left free enough to pivot back and forth around axes defined by the tube connectors. Upper ends 72, 74 of the legs are cut at an angle of 45° with respect to the length of the legs to enable the legs to be restrained in flush contact with sides of member 30 at the same angle when fully extended at the bottoms of the legs.

FIG. 2 shows placement of a rigid sign flush against legs 16, 18 and supported by buttons 76, 78 on these legs. The upper corner of the sign may be secured in place by hooking elastic cord 36 around this corner or elsewhere along an upper edge. Tension of the elastic cord is controllable by sliding the support bracket 26 down to the appropriate level and tightening the set screw 58. This configuration is preferred for use when prevailing winds are directed into the sign face.

Figure 3:
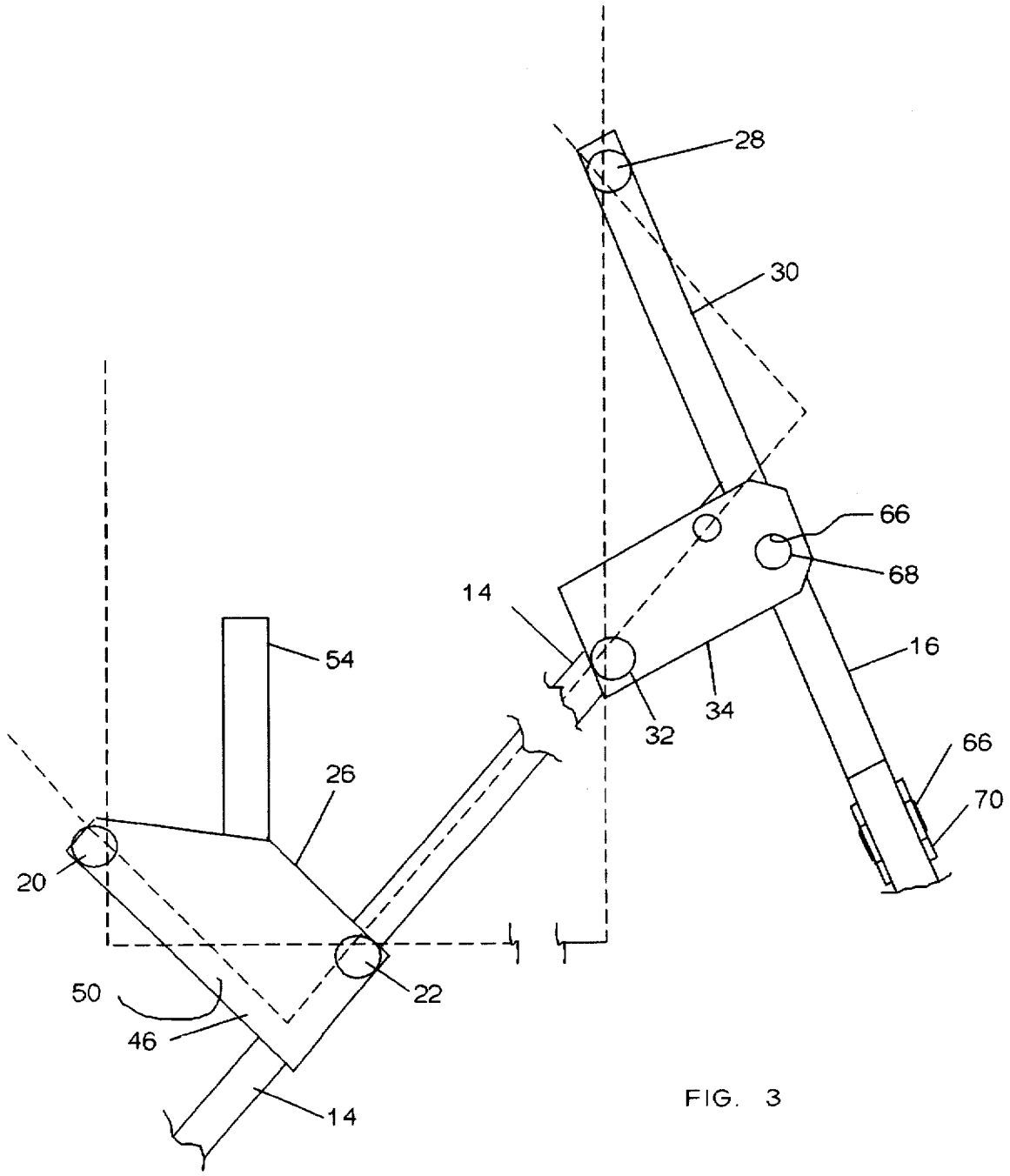
FIG. 3 is an enlarged view showing a self-aligning bracket, along with a center support member and related hardware supporting a rectangular sign, in dotted lines.

Angular relationships of the legs of the tripod to one another and to the center support member are arranged to provide for proper placement of the pairs of buttons. As shown in FIG. 3, leg 14 is connected in fixed relationship between plates 34 and 35 and pivots around an axis defined by tube 66 when being erected or folded up. When the leg is fully extended, button 32 is brought into vertical alignment with button 28. When erected, legs 16 and 18 are disposed at an angle of 90° to one another and 45° with respect to the center support member. Main support leg 14 assumes an angle of 65° with respect to the center support frame member which supports the tube axis around which this leg pivots. The center support member is coplanar with legs 16 and 18, and it receives the tube connector 66 at a point which may be five inches upward from pivot tubes 64, 66.

The sign stand of the present invention forms a compact, easily transported package upon being removed from deployment and folded up. Removal of the sign may be carried out by lifting it off the stand, slightly twisting the sign if necessary. Legs 16 and 18 need only to be folded together, and leg 14 may also be folded inward upon pressing in and thereby releasing the detent mechanism. The elastic cord 36 may be used to tie the parts together.

Optimum placement of the sign and stand depends on the prevailing wind direction and the type of sign. For rigid signs, when the wind direction varies, placement on the side of the tripod as shown in FIG. 1 is preferred. For prevailing winds directed into the face of the sign, placement of rigid signs on two legs as shown in FIG. 2 gives best results. Rolled-up signs which are carried on the receptacles supported by the main support leg are preferably carried to the side of the tripod similar to the placement shown in FIG. 1, and for winds directed into the sign face, rotation of the tripod to have the main support leg point toward oncoming traffic preferred. Sign stands embodying the invention provide effective support of rigid signs against winds up to approximately 16 miles per hour at variable wind directions and 30 miles per hour for straight-on winds blowing into the sign face. Similar results are obtained for roll-up signs. Increased wind ratings may be obtained by use of ballasts to weight the tripod down.

Safety of the sign stands is enhanced due to minimized weight, consistent with adequate strength, along with providing break-away features. For example, the bottom end of the center support member which carries the main support leg and sign may be connected to plates 34, 35 between which it is sandwiched, only by compression from the plates and by use of an acrylic-type epoxy adhesive. Upon application of a strong wind force from the side, the wind produces a torsion effect, resulting in break-away and release of the joint if the wind reaches a high enough level. While the invention is described above in terms of specific embodiments, it is not to be understood as limited thereby, but is limited only as indicated by the appended claims.

What is claimed is:

1. A portable sign stand comprising: first, second, and third legs and a center support member, each having a top and a bottom;

said first leg having a bracket slidably mounted thereon;

the tops of said second and third legs and the bottom of said center support member connected to one another at a junction area;

said second and third legs and said center support member being aligned in a first common plane;

said bracket including a plate defining a second plane parallel to said first leg and perpendicular to the plane of said second and third legs;

said plate having attached thereto a first pair of spaced-apart buttons for receiving therebetween a corner or a side edge of a rigid sign;

a second pair of buttons disposed generally in said second plane, one button of the second pair carried by said first leg near to said junction area, and the second button of said second pair carried by said center support member, said buttons of said second pair being spaced apart vertically aligned with one another; and a spring connected to said bracket and urging the same upward whereby a rigid sign located between said two pairs of buttons will be brought into a desired viewing position.

2. A sign stand as defined in claim 1 comprising a clevis-pin connector joining said second and third legs and said extension member.

3. A sign stand as defined in claim 2 comprising a first pair of plates connected to tops of said second and third legs at opposite sides thereof and pivot axis members carried by said plates.

4. A sign stand as defined in claim 3 wherein the bottom end of said extension member is disposed between said pair of plates and between the tops of said second and third legs, said extension member is held in fixed position with respect to said pair of plates, and said second and third legs are mounted for pivotal movement together and apart.

5. A sign stand as defined in claim 4 wherein said spring comprises an elastic cord connected at one end to said bracket and at the other end thereof connected to a structural member adjacent to said junction area.

6. A sign stand as defined in claim 5 wherein said legs and extension member comprise square tubing made of metal.

7. A sign stand as defined in claim 6 wherein said metal is an aluminum alloy.

8. A sign stand as defined in claim 5 comprising a second pair of plates connected to the top of said first leg on opposite sides thereof and to said extension member on opposite sides thereof, said plates being fixedly connected to said first leg and pivotally connected to said extension member.

9. A sign stand as defined in claim 8 wherein said second and third legs, when unfolded and erected, are located at an angle of 90° to one another.

10. A sign stand as defined in claim 9 wherein said first leg, when erected, is disposed at an angle of 65° with respect to the plane of said second and third legs when erected.

11. A sign stand as defined in claim 10 wherein said buttons comprise elevator bolts.

12. A sign stand as defined in claim 1 comprising a receptacle mounted on said bracket and shaped to receive a mast of a rolled-up sign, said receptacle extending vertically upward when erected.

13. A sign stand as defined in claim 12 comprising a set screw carried by said bracket and engageable with said first leg to restrain the bracket from movement.

14. A sign stand as defined in claim 1 comprising a pair of buttons located in aligned relation with one other on outside faces of said second and third legs whereby a rigid stand may be supported therebetween flush to said second and third legs.

15. A portable sign stand comprising:

first, second, and third legs and a center support member, each having a top and a bottom;

the tops of said second and third legs and the bottom of said center support member pivotally connected to one another in a common plane whereby said second and third legs may upon erection be brought into an angle of 90° with respect to one another and 45° with respect to said center support member;

said first leg pivotally connected to said center support member whereby upon erection said first leg may be extended at an angle of 65° with respect to said center support member;

a vertically movable bracket carried by said first leg and including an elastic cord to urge upward a rigid sign mounted thereon;

a first pair of buttons carried by said bracket and spaced apart generally horizontally from one another for receiving a rigid sign; and a second pair of buttons disposed above said first pair of buttons for receiving and securing said sign, and one button of said second pair carried by a side face of said center support member, a second button of said second pair aligned vertically with said first button of said second pair and carried by a side face of said first leg.

16. A portable sign stand as defined in claim 15 comprising a first pair of plates disposed on opposite sides of tops of said second and third legs and the bottom of said center support member, said center support member disposed between said second and third legs.

17. A portable sign stand as defined in claim 16 including a pivotal junction between said plates and said tops of said second and third legs comprising a pair of tube segments, one of each extending through said plates and a said top of a leg and ends of said tubes compressed inward to secure the same in position.

18. A portable sign stand as defined in claim 17 including a second pair of plates disposed on opposite sides of said first leg and said extension member, pivotally connected to said center support member and fixedly connected to said first leg.

* * * * *